United States Patent [19]

Kaessmann

[11] 4,396,369

[45] Aug. 2, 1983

[54] FURNACE AIR VOLUME CONTROL APPARATUS

[75] Inventor: Gustav Kaessmann, Monchengladbach, Fed. Rep. of Germany

[73] Assignee: SERVO-Instrument, Monchengladbach, Fed. Rep. of Germany

[21] Appl. No.: 217,225

[22] Filed: Dec. 17, 1980

[30] Foreign Application Priority Data

Dec. 17, 1979 [DE] Fed. Rep. of Germany ..... 2950689

[51] Int. Cl.[3] ..... F23N 5/00

[52] U.S. Cl. ..... 431/76; 236/15 E

[58] Field of Search ..... 236/15 E, 15 C; 431/76, 431/12

[56] References Cited

U.S. PATENT DOCUMENTS

| | | | |
|---|---|---|---|
| 3,964,675 | 6/1976 | Euchner, Jr. | 236/15 C |
| 3,985,294 | 10/1976 | Guido et al. | 236/15 C |
| 4,043,743 | 8/1977 | Seider | 431/12 X |
| 4,253,404 | 3/1981 | Leonard | 236/15 E X |
| 4,262,843 | 4/1981 | Onori et al. | 236/15 E X |
| 4,330,261 | 5/1982 | Sun | 236/15 E |

FOREIGN PATENT DOCUMENTS

| | | | |
|---|---|---|---|
| 984488 | 2/1976 | Canada | 236/15 E |

*Primary Examiner*—Edward G. Favors

*Attorney, Agent, or Firm*—King and Liles

[57] ABSTRACT

A furnace air volume control apparatus for controlling the volume of furnace air to achieve efficient burning is disclosed. The apparatus includes regulating valves positioned within supply air inlets and exhaust gas outlets of the furnace. A measured data receiver positioned on the exhaust gas side transmits a measuring signal to a control unit connected to the regulating valves. The control unit includes a storage unit for storing valve positions assigned to respective burner loads. By monitoring various exhaust gas parameters with the measured data receiver and control unit valve position, adjustment in response to changes in the burner load is possible by comparing a previously stored valve position recalled from the storage unit with a characteristic curve. The valve adjusting value stored in the storage unit is essentially congruent with the change in burner load. After exhaust gas stabilization has occurred in response to different burner loads precise correction of the valve position value occurs.

10 Claims, 2 Drawing Figures

FURNACE AIR VOLUME CONTROL APPARATUS

TECHNICAL FIELD

This invention generally relates to a control apparatus for controlling the volume of furnace air with at least one regulating valve for changing furnace air volume and a measured data receiver positioned on the exhaust gas side of the furnace. A measuring signal is transmitted by the measured data receiver to a control unit connected to the regulating valves for the purpose of changing the volume of furnace air.

BACKGROUND ART

The control of furnace air volume as a function of measured exhaust gas values with a measured data receiver positioned on the exhaust gas side of a furnace is known. However, there exists a disadvantage in that after a change in volume of supply air occurs, the values corresponding to the changed supply air volume can only be measured when the change has become noticeable in the exhaust gas, a process taking several seconds. This is especially disadvantageous in view of changes in the burner load, occurring comparatively rapidly and causing very fast changes in oxygen values and the characteristic curve of the valve position for changing the furnace air volume.

DISCLOSURE OF INVENTION

To eliminate the above problem, the present invention provides that a control unit connected to the valves for changing the furnace air volume include a storage unit for storing the position of the valves that is assigned to the respective burner load, for influencing the furnace air volume. This makes possible control unit storage of the drive out position, and in particular, the lifting position of the supply air motor at the respective burner load. When an identical burner load is later encountered, the stored lifting position is then selected, prior to a precision control of the desired exhaust gas values by means of a rapid speed servo-motor respectively connected to the valves for controlling the furnace air volume. For this purpose, the control unit includes a micro-processor.

In accordance with the invention, when the burner load is changed, the position of the valve is entered immediately without waiting for changes in exhaust gas values that can only be measured later, which the storage unit provided in the control unit has stored as the value which the valve has used in the case of a burner load corresponding to the burner load now being used. A precision control as a function of the exhaust gas values only takes places subsequently. The valve means for controlling furnace air volume usually includes flaps activated by a servo-motor. On the exhaust gas side, the residual oxygen value can be measured. When a change in burner load occurs, the corresponding change in residual oxygen value not only takes place in a delayed manner, and is non-linear, but the corresponding curve has an off course tendency and only adjusts slowly to the new constant value. If readjustment of the valve position assigned to the new burner load as a function of the residual oxygen value measured in the exhaust gas occurs, an impractical result would obtain; in view of the fact that until the time of stabilization, undue burning values may occur. In accordance with the present invention, however, valve readjustment for controlling furnace air volume as a function of changes in the burner load takes place immediately and with a linear course to the flap adjusting value stored in the storage unit and is thus practically congruent with the change of the burner load. When the measured value, for example, a residual oxygen value, measured on the exhaust gas side has stabilized, the precise correction to the desired value takes place.

In a different embodiment of the invention, the storage unit stores the new adjusting value of the valve which, in a given situation of external control of the burning, corresponds to the desired oxygen value in the case of a given burner load. This measure takes into account the fact that optimal burning is not achieved in the case of all external influences. For example, under different climatic conditions, the same flap positions will not result in optimal burning, but that under varying external conditions, different positions lead to optimal results. In this case the storage unit stores the flap adjusting value last used for a certain burner load after precision regulation.

Because of the serious hysteresis problems of burner control, the invention, in a further embodiment, includes a storage unit capable of remembering whether the position assigned to the respective burner load was entered based upon a larger or smaller burner load. Information storage of this nature occurs in a microprocessor.

According to another feature of the invention, the measured value receiver on the exhaust gas side of the furnace is capable of measuring the flue gas density or soot density (oil burning), CO-value (gas burning), or functioning as a sensor for the optical detection of the flame temperature spectrum. This measure is based upon the fact that the adjustment of oxygen values depends upon the minimum volume of supply air, at which burning still takes place without extensive soot or CO formation, and that the soot or CO value represents a guide value for the residual oxygen value, and that the flame temperature, in the case of too much or too little furnace air, decreases in each case. The direct control obtained according to soot, CO, or flame temperature values offers the advantage that the control unit need only receive one single desired value. According to the prior art (for example, DE-OS No. 2451565) furnace air volume control on the supply air side takes place as a function of oxygen content in the exhaust gas, in which case it is necessary to supply the control unit with desired oxygen values as a function of the burner load, since the possible and optimal oxygen values are not the same for all burner loads.

Another advantage of the invention resides in the fact that mechanical changes at the burner, burner nozzle, or soot deposits in the boiler, having an influence on the optimal minimum oxygen values, are directly taken into account in the measurement. Thus, the desired soot, CO-value or desired flame temperature value adjusted at the control unit can always be maintained; whereas, a desired oxygen value curve may be subject to eventual changes requiring at least one annual checkup.

The device for measuring flue gas or soot gas density is preferably a photoelectric apparatus. In addition, measuring of oxygen values in the exhaust gas may take place for monitoring purposes.

For improving combustion efficiency, the invention may provide that regulating valves for furnace air volume control on the supply air side and exhaust gas side be adjusted in relation to each other and simultaneously operated by the control unit. This is advantageous for the following reasons. If the case of controlling supply air as a function of the respective exhaust gas values, there exists a disadvantage such that by regulating furnace air volume in this manner, the furnace pressure is negatively influenced by the control unit takes place only on the supply air side which limits the control or optimization of the furnace air volume. In particular, the furnace air volume must not be throttled to an arbitrary extent, since with increasing reduction of the furnace air volume the furnace pressure falls and the mixed energy of fuel and furnace air is decreased to such an extent that an optimal burning no longer takes place thus leading to the undesired development of CO or soot. In the case of performance regulated burners, especially under small loads, this problem is very serious. In accordance with the present invention however, simultaneous control on the supply air side and exhaust gas side increases furnace pressure by establishing a resistance on the exhaust gas side with respect to the ventilator pressure on the supply air side. Thus, the mix energy of furnace air and fuel on the supply air side is maintained with a simultaneous reduction of the furnace air volume. Since control of furnace air volume takes place on the supply air side as well as the exhaust gas side, the volume of furnace air is optimally limited, and efficient combustion is continuously maintained under all load phases of the burner with the exclusion of the parameters influencing the furnace air.

The regulating valves for controlling furnace air volume on the supply air side and exhaust gas side preferably include flaps. Alternatively, air volume control on the supply air side may be accomplished with a speed control for the ventilator. A so called zero position is assigned to both valves. In the case of the valve controlling furnace air volume on the exhaust gas side this zero position signifies that the valve is fully open. With regard to the valve controlling air volume on the supply air side the zero position may indicate the fully extended or fully pushed in position. The total height of valve lift for the control of furnace air volume on the supply air side is limited by limit switches defining end positions. Which one of the two end positions is considered to be the zero position depends upon at which position supply air volume addition is insured at which perfect burning occurs, however, with unsatisfactory exhaust gas values. According to the invention, valves are now provided by means of which the valves for controlling furnace air volume on the supply air side and exhaust gas side in the case of burner shut down or other disturbances, take up the zero position or an open starting position. Based upon this zero or open starting position, when the flames start, control in either case takes place in the direction that decreases the supply air volume. With this feature of the invention, in the case of burner preventilation and start of the flames, the zero positions of both valves may be taken up, with control according to exhaust gas values initiated only after the start of burning.

According to another feature of the invention, a safety circuit is provided to ensure safe burning in the event of defective control. This safety circuit operates to return the valve controlling supply air back into zero position or open starting position when the respective desired soot, CO or oxygen values are not reached or exceeded. A time switch unit for monitoring the return of the valve to zero position or open starting position is provided. After a predetermined time interval, the time switch unit emits a signal causing an interference report or switch off of the burner. A device responsive to soot, CO or oxygen values operates in the following manner. Exhaust gas values at a measuring point are compared and recalibrated at regular intervals by admittance at the measuring point of a certain oxygen concentration from a graduated bottle. A particular band width is assigned to the desired value curve indication and the measured soot, CO or oxygen value is compared to the band width assigned to the indicated values in order to determine whether the measured values are within or outside the indicated values. When these values are exceeded or not reached, a supply air servo-motor drives the valve directly to zero or open starting position. This may take place with an outside electric circuit or mechanically. The reaching of the zero or open starting position is monitored by the time switch unit. Should a defect occur, especially at the servo-motor of the supply air valve, preventing the servo-motor from driving back into the zero or open starting position, after the expiration of an indicated time interval, the time switch unit is operative to emit a signal causing an interference report and/or burner shut down.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

BEST MODE FOR CARRYING OUT THE INVENTION

Figure 1:
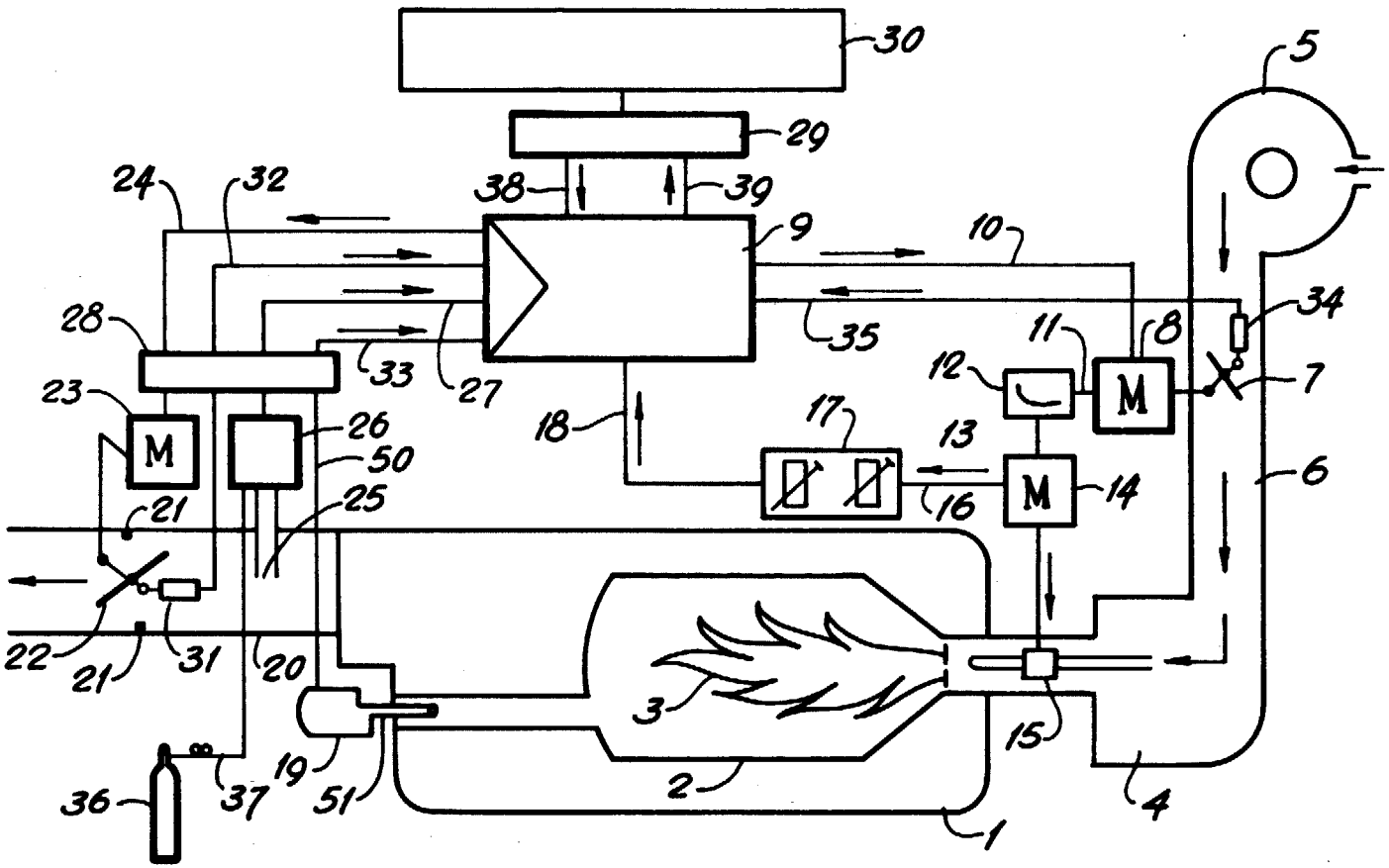
FIG. 1 is a schematic view of the furnace air control apparatus of the present invention.
Figure 2:
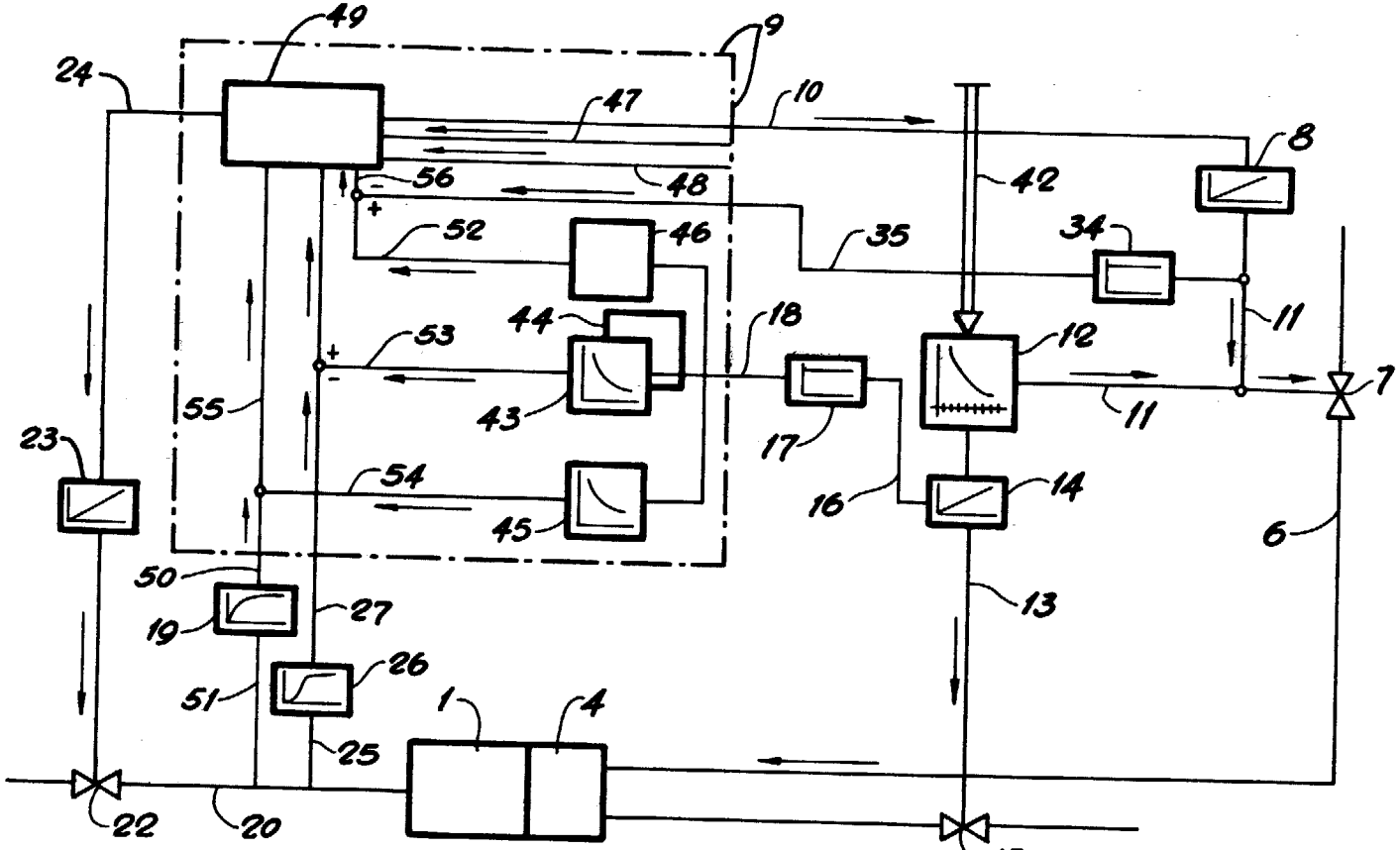
FIG. 2 shows a means for detecting the operating phase of the burner for controlling regulating valves.

Reference will now be made in detail to the present preferred embodiment of the invention an example of which is illustrated in the accompanying drawing. Referring to FIG. 1, boiler 1 is shown and includes a burner 4 directing flame 3 into the furnace 2. Furnace air is supplied to the burner 4 by ventilator 5. In the supply air duct between ventilator 5 and burner 4, regulator valve 7 is positioned and is operated to control the flow path through the supply duct by servo-motor 8. Servo-motor 8 has several speed ranges and is capable of controlling the air volume supplied to furnace 2 through the supply air duct.

For the purpose of controlling furnace air volume in the above manner, control unit 9 is connected to servo-motor 8 with control line 10. Servo-motor 8 is connected to a coupled control element 12 with control line 11, and the coupled control element is connected to a servo-motor 14 by line 13. Servo-motor 14 is provided for operating burner valve 15. In addition, servo-motor 14 is connected to burner load cell 17 with control line 16; and in turn, the burner load cell is connected to control unit 9 with control line 18. A sensor for the optical detection of the flame temperature spectrum is provided, but not shown.

On the exhaust gas side, valve 22 is positioned in exhaust gas duct 20 and is operative to fully close the exhaust gas duct upon contacting stops 21. Valve 22 is controlled by servo-motor 23, connected to control unit 9 by control line 24. Measured data receiver 25 is also positioned in exhaust gas duct 20. In an oil burning furnace, for example, measured data receiver 25 comprises a photoelectrically operating device, and measures flue-gas density or soot density. In gas burning furnaces, receiver 25 is designed to measure CO-values. In addition, receiver 25 is designed to measure the oxygen content in the exhaust gas or pressure in the exhaust pipe. Alternatively, a sensor may be provided for the optical detection of the flame temperature spectrum.

Valves 7, 22 operate in the following manner. Sensor 26 continuously measures flue gas density or soot density (for oil burning devices), CO-value (gas burning device), or flame temperature. In addition, the residual oxygen content and exhaust gas pressure is measured continuously. The respective burner load is first selected by servo-motor 14 on the supply air side of the furnace, and the furnace air volume is adjusted as a function of the oxygen value measured in the exhaust gas; or, in a more advantageous manner, as a function of flue gas density, soot density, measured CO-value, or flame temperature, depending upon the fuel burned. Through throttling of valve 7, the mixing energy through ventilator 5 decreases, simultaneously reducing the furnace pressure, resulting in inefficient burning. However, by controlling pressure on the exhaust gas side of the furnace, furnace pressure is simultaneously regulated in relation to the throttling of supply air such that as the flow of supply air decreases, as discussed above, the mixed energy of the ventilator is maintained and thus optimal burning is achieved, even under small loads. The measurement of oxygen values in the exhaust gas are used for directly controlling the furnace air volume by adjusting valves 7, 22 in the supply air side and exhaust gas side respectively. Alternatively, in the case of controlling furnace air as a function of flue gas or soot density, CO-value or flame temperature for control purposes, optimal burning is achieved such that when a band width of the residual oxygen value (the corresponding values are transmitted to the control unit) assigned to the respective burner load is exceeded or not achieved, the valve 7 is fully open. This process is monitored by means of a time switch unit (not shown) that is connected to the control unit 9. If valve 7 movement to a fully open position is prevented (e.g., due to a defect in servo-motor 8), burner 4 is shut down and an interference report is transmitted simultaneously by means of a time switch unit (not shown) connected to control unit 9.

Measured data processing unit 28 is provided for amplifying measuring signals for the purpose of transmission. Circuit diagram 29 have transmission relays is connected to switch panel 30 where the burner control is located. The circuit connection with the switch panel 30 transmits information concerning the operating phase of the burner and the safety switch-off. A position potentiometer 31 is connected to exhaust gas valve 22 by control lines 32, 33 and serves as a sensor. Position potentiometer 34 is connected to supply air valve 7 and also serves as a sensor. Potentiometer 34 is connected by control line 35 with control unit 9. A graduated gas bottle 36, containing a defined oxygen concentration, interconnects with sensor 26 through pipe 37. Control lines 38, 39 connect control unit 9 to transmission relay 29. The influence of the burner control on coupled control element 12, in diagram form, has the reference number 42. The desired value curves for oil or gas fuels of the burner are indicated by reference numerals 43, 44. With these curves 43, 44 the desired oxygen value can be indicated as a function of the burner load. In the coordinate system shown in diagram form, the oxygen value is listed on the ordinate and the burner load value is listed on abscissa. In addition, the desired pressure value curve 45 is provided wherein the ratio between pressure and burner load can be indicated.

Storage unit 46 is provided for the purpose of storing the positions of supply air valve 7 and exhaust gas valve 22 assigned to the respective burner load. By means of position potentiometers 34, 31, the respective valve positions are converted into electrical measuring signals and transmitted to storage unit 46. Through lines 47, 48 a control center 49 including a micro-processor detects what type of fuel (e.g., oil or gas) the burner is using. This information is necessary for the purpose of recalling the correct desired value curve 43 or 44.

Control line 50 leads from the pressure pick off 19 to control unit 9. Pressure pick off 19 is connected with boiler 1 through channel 51. Connections have the reference numbers 52–56.

The foregoing description of a preferred embodiment of the present invention has been presented for the purposes of illustration and description. It is not intended to be exhaustive or to limit the invention to the precise form disclosed, and obviously many modifications and variations are possible, in light of the above teachings. The embodiment was chosen and described in order to best explain the principles of the invention and its practicle application to thereby enable others skilled in the art to best utilize the invention in various embodiments and with various modifications as are suited to the particular use contemplated. It is intended that the scope of the invention be defined by the claims appended thereto.

I claim:

1. A furnace air volume control apparatus for controlling furnace air volume of furnace (1) with at least one regulator valve (7, 22) for changing the volume of furnace air with a measured-data receiver (25) positioned on an exhaust gas side and transmitting a measuring signal to a control unit (9), said control unit regulating the position of said regulator valves for the purpose of changing furnace air volume, the improvement comprising storage unit means connected to the control unit (9) for storing the position of said valves (7, 22) for controlling furnace air volume.

2. A furnace air volume control apparatus according to claim 1, wherein said storage unit is capable of storing the new adjusted value of said valve positions (7, 22) for controlling the furnace air volume in a given situation of external control of the burning corresponding to the desired oxygen value in the case of a given burner load.

3. A control apparatus according to claim 1 or 2, wherein said storage unit is capable of remembering whether the position assigned to the respective burner load was entered based upon a larger or smaller burner load.

4. A control apparatus according to claim 1, wherein said measured value receiver (25) is capable of measuring flue gas density and soot density in oil burning furnaces, CO-value for gas burning furnaces, and further includes a sensor (19) for the optical detection of the flame temperature spectrum.

5. A control apparatus according to claim 1, wherein said regulator valves (7, 22) controlling furnace air volume are positioned on the supply air side and exhaust gas side and adjusted in relation to each other, said valves capable of being affected simultaneously by said control unit (9).

6. A control apparatus according to claim 5, further comprising a value-receiver positioned on the exhaust gas side of the furnace for measuring oxygen values and pressure.

7. A control apparatus according to claim 1, further comprising means for fully opening the regulator valves (7, 22) during burner switch off and malfunction or before start up of the flame.

8. A control apparatus according to claim 1, further including means for fully opening said regulator valves (7, 22), said means energizing said valves when the permissible oxygen band width per burner load or other threshold values and in the case of the response of other monitoring functions is exceeded, said means energizing said valves to fully open position, and a time switch device for monitoring the fully open valve position, wherein said time switch device is operative to transmit a signal causing a disturbance report and switch off the burner when an indicated time interval is exceeded.

9. A control apparatus according to claim 1, further comprising an adjusting device for the adjustment of the permissible oxygen band width corresponding to the course of a desired curve of the oxygen value as a function of the burner load.

10. A control apparatus according to claim 1, further comprising potentiometers connected to said regulator valves, wherein said potentiometers correspond to the respective adjusting value and the responder values of the potentiometers are compared by addressing limit switches and are monitored by them.

* * * * *